United States Patent [19]

Yan

[11] Patent Number: 4,650,495

[45] Date of Patent: Mar. 17, 1987

[54] METHOD FOR STABILIZING DRIED LOW RANK COALS

[75] Inventor: Tsoung Y. Yan, Philadelphia, Pa.

[73] Assignee: Mobil Oil Corporation, New York, N.Y.

[21] Appl. No.: 748,882

[22] Filed: Jun. 26, 1985

[51] Int. Cl.[4] ..... C10L 5/24

[52] U.S. Cl. ..... 44/1 G; 44/1 R; 44/27; 34/9

[58] Field of Search ..... 44/1 G, 27, 1 R; 34/9

[56] References Cited

U.S. PATENT DOCUMENTS

| | | | |
|---|---|---|---|
| 3,985,517 | 10/1976 | Johnson | 44/1 R |
| 4,201,657 | 5/1980 | Anderson et al. | 208/23 |
| 4,396,394 | 8/1983 | Li et al. | 44/1 G |
| 4,396,395 | 8/1983 | Skinner et al. | 44/6 |
| 4,401,436 | 8/1983 | Bonnecaze | 44/1 G |
| 4,402,706 | 9/1983 | Wunderlich | 44/1 G |
| 4,502,947 | 3/1985 | Haddad et al. | 208/161 |

*Primary Examiner*—Carl F. Dees

*Attorney, Agent, or Firm*—Alexander J. McKillop; Michael G. Gilman; Charles A. Malone

[57] ABSTRACT

A method for pyrophoric particle protection of carbonaceous material particularly low rank coals where the material is simultaneously coated with a treating agent and cooled by a fluidizing gas.

30 Claims, 2 Drawing Figures

METHOD FOR STABILIZING DRIED LOW RANK COALS

FIELD OF THE INVENTION

This invention relates to a method for producing a cooled, dried low rank coal which coal is resistant to spontaneous combustion.

BACKGROUND OF THE INVENTION

Low rank coals, sub-bituminous, lignite and peat contain moisture between about 20 to 50 weight percent, resulting in low heat content. Therefore, low rank coals containing high moisture levels are expensive to transport which severely restricts its marketing. Unfortunately, the coal mines are located in areas with low coal demand, for instance, Wyoming and North Dakota. High moisture coal can freeze in the winter and make handling and transportation difficult. In addition, use of low heat content coal in an industrial furnace often requires derating the existing units and increasing the design capacity for the new units.

During the drying of low rank coals, coal particles tend to shrink, crumble, disintegrate, and form excess amounts of fines and dust. Excessive amounts of fines and dust degrade the product. This makes the product difficult to handle and transport. Most importantly, auto-ignition can occur during the drying operation.

Johnson et al. in U.S. Pat. No. 3,985,516 issued Oct. 12, 1976 disclose a coal drying and passivation process. In this process, particulate pyrophoric low rank coals were passivated in a vessel containing a drying zone and a subadjacent coating zone. In this process, the fluidized gas was heated to a temperature sufficiently high to vaporize the moisture in the coal but below the temperature at which the carbonaceous material or coal will devolatilize.

Therefore, what is needed is a method to simultaneously passivate and cool carbonaceous particles.

SUMMARY OF THE INVENTION

This invention is directed to a method for pyrophoric particle protection where the heated particles containing moisture are fluidized, cooled and treated with a pyrophoric protection fluid or treating agent within a vessel utilizing cyclone separators in combination with a pressurized cooling fluid.

This method includes heating and drying said particles in a manner sufficient to substantially reduce the moisture content of said particles. Next, the heated and dried particles are introduced into a vessel where in one embodiment said particles are fluidized by a gaseous fluid, cooled and simultaneously coated with a pyrophoric protection fluid which causes said particles to agglomerate. Afterwards, the cooled, agglomerated particles are continuously removed from the bottom of said vessel. Resultant gaseous fluids are removed from the top of said vessel. Upon removal from the vessel, the cooled, agglomerated particles are protected from fire hazards due to the treating received in the vessel. Spontaneous combustion of the particles is substantially minimized. Also, dust formation is substantially minimized.

Therefore, it is an object of this invention to stabilize particles which are prone to dust formation and auto-ignition, particularly low rank coals.

Another object is to provide a process to effectively carry out the pyrophoric particle protection treatment of low rank coals.

A yet further object is to integrate the pyrophoric particle protection treatment into the drying process to reduce capital investment and operation costs.

A still yet further object of this invention is to provide a method to minimize the harmful environmental impact of dust formed during the processing of grains, wood products, and low rank coals.

DESCRIPTION OF THE PREFERRED EMBODIMENTS

Figure 1:
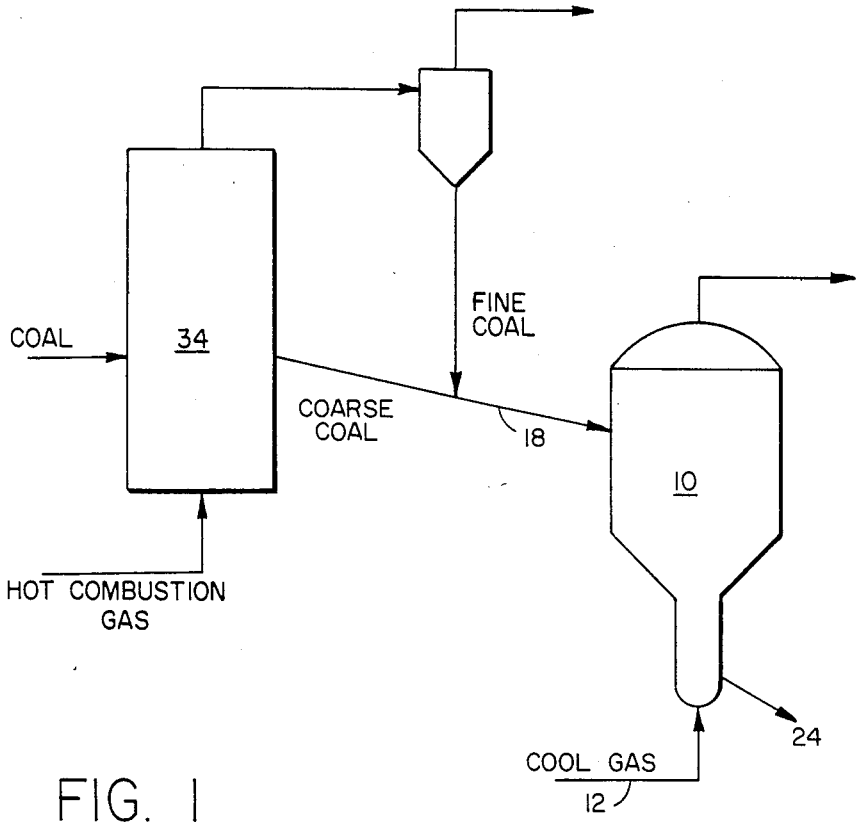
FIG. 1 is a schematic of the method showing the relationship of the dryer and the treating vessel.

In the operation of this invention, as shown in FIG. 1, a low rank coal such as sub-bituminous, lignite or peat is dried in a dryer 34. These coals often contain moisture in the amount of from about 20 to about 50 weight percent. With the aid of crushing and handling during the drying process, the coal is reduced to about one half inch in diameter. Upon leaving the dryer via line 18, the hot dried coal is of a temperature of from about 150° to about 250° F. Moisture contained in the dried coal is generally at about 8–12 weight percent. This moisture content is lower than the critical moisture level. Critical moisture is defined herein as the water held loosely by the coal which can be removed easily by physical means such as draining or centrifuging, etc.

Drying low rank coals to an acceptable moisture level of from about 8–12 weight percent causes low rank coal, especially Western low rank coal particles to shrink, crumble, disintegrate, and form excessive amounts of fines and dust. If left untreated, these excessive amounts of fines and dust would degrade the product making it difficult to handle and transport. Most importantly, such product can create safety and fire hazards via spontaneous combustion. Therefore, it is imperative to treat and cool heated low rank coals before these coals are stored. Also, in order minimize the potential for spontaneous combustion, it is preferred to cool low rank coals as quickly as possible after drying said coals.

Figure 2:
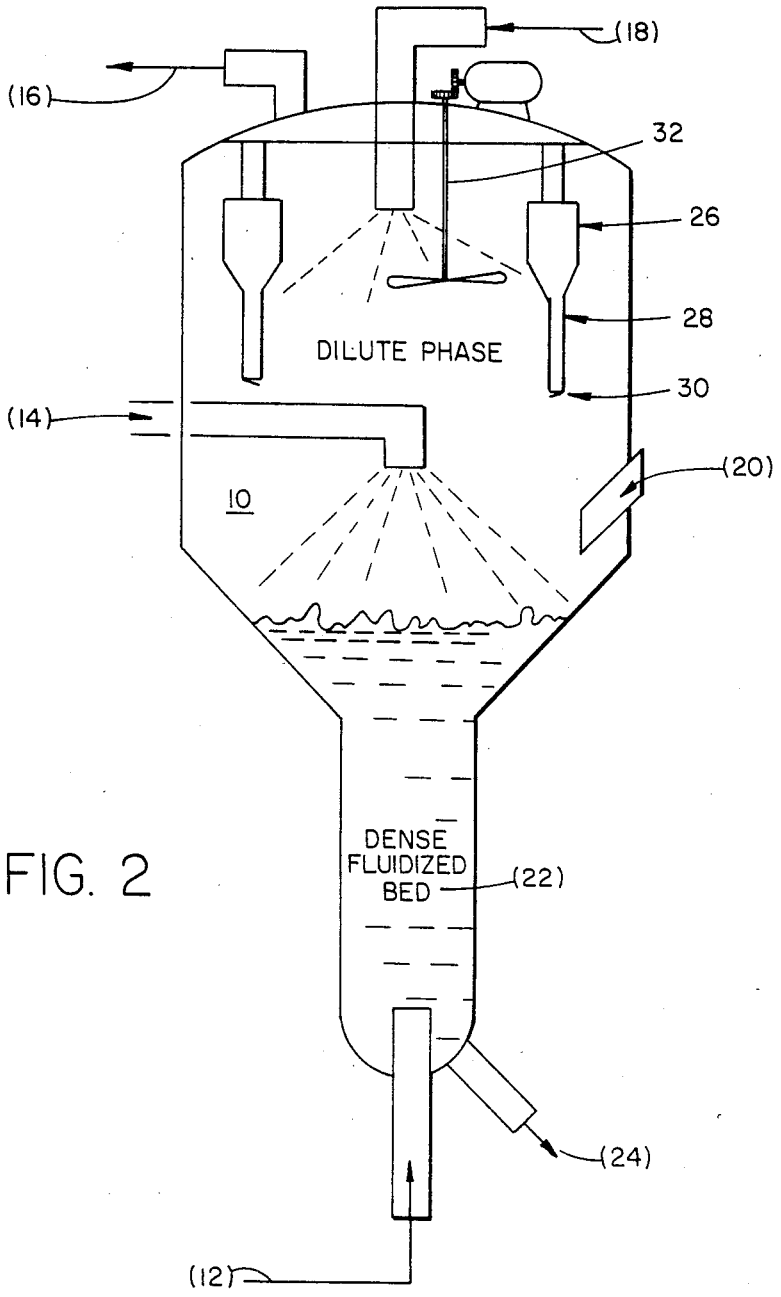
FIG. 2 is a schematic view of the pyrophoric particle protection vessel showing the circumferential difference between the bottom section and top section of the vessel.

To minimize these problems, hot dried coal of a temperature of from about 150° to about 250° F. upon leaving the dryer is charged through the top of a treating reactor 10 via line 18 as is shown in FIG. 2. Upon entering reactor 10, the hot dried coal particles are contacted with a pyrophoric protection fluid or treating agent which enters reactor 10 via line 14. These coal particles are then covered by said protection fluid which causes the coal particles to agglomerate and fall to the bottom of reactor 10 forming a dense bed 22.

In order to ensure cooling and contact of the coal particles with the pyrophoric protection fluid, a gaseous fluid is injected into the bottom of the reactor 10 via line 12. This is shown in FIG. 1 and FIG. 2. Injection of the gaseous fluid causes the dense bed to become fluidized. In the bottom of the reactor which is smaller in diameter than the diameter of the reactor's top, the fluidized coal is cooled, agitated, and classified. This causes a substantially good mixing of the coal which moves the small coal particles to the top of the fluidized bed, where the finer coal fraction particles are preferentially treated with said fluid.

The dimensions of the reactor are critical. The diameter ratio of the top and bottom sections are selected so that the gas velocity will lead to a substantially acceptable level of fluidization for effective mixing at the bottom section. To accomplish this, as is shown in FIG. 1 and FIG. 2, the bottom of the reactor is smaller in diameter than the top of the reactor 10. The diameter ratio is about 1.5 to about 5. Generally, the gas will be injected at a velocity of about 5 to about 20 feet per second at the lower or bottom section. As is preferred, at the upper or top section, a velocity of about 1 to about 5 feet per second is sufficient to prevent unagglomerated coal particles and mist from the treating agent to carry over into the top section of reactor 10 at a substantially low and acceptable level.

In another embodiment, unagglomerated coal particles may be contacted with a pyrophoric protection fluid or treating agent by a spouting mode. To accomplish this, a gaseous fluid is injected into the bottom of the reactor 10 via line 12 so that at a velocity less than about 1 foot to about 5 feet per second is maintained at the upper or top section of the reactor. Injection of the gaseous fluid at a velocity less than about 1 foot to about 5 feet per second into the upper or top section of the reactor causes a "spouting" or "puffing" of the unagglomerated coal. This "spouting" or "puffing" action causes an intermittant mixing of the unagglomerated coal particles with the pyrophoric protection fluid or treating agent.

Utilization of the fluidized or spouting mode is determined by the coal rank and moisture content of the coal. Also, the spouting mode can be used to obtain a heat balance between the solid particles and the cooling gas. Removal of moisture from a lower rank coal requires a higher heating temperature. The "spouting" or "puffing" mode is particularly preferred when processing a high rank coal, e.g. bituminous. Since less moisture is contained in high rank coal, the "spouting" or "puffing" mode can be operated at a temperature of about 80° to about 100° F., preferably about 100° F.

The moisture content of low rank coal can be reduced from about 30–35% by weight to about 10% by weight upon heating the coal entering reactor 10 for about 3 to about 5 minutes. A moisture reduction of 10 weight percent can be obtained by heating the coal to a temperature of about 220° F. for about 3 minutes. Upon heating the coal to a temperature of about 205° F. for about 5 minutes, the moisture can be reduced to about 10 weight percent. If the temperature is maintained at about 200° F. for about 5 minutes, the moisture can be reduced to about 10 percent by weight. Agglomerated coal particles are removed from the bottom of the reactor via line 24, as is shown in FIG. 1 and FIG. 2. Cooled coal particles are withdrawn continuously to maintain the level of the fluidized bed. Upon exiting the bottom of reactor 10, the temperature of the exiting cooled coal particles is about 80° to about 120° F., preferably about 100° F.

As shown in FIG. 2, cool coal fines carried up by the gaseous fluid from line 12 are captured via at least one gas-solid separator or internal cyclone 26. Although internal cyclones are utilized in the embodiment, the cyclones can be either internal or external to said reactor or vessel. Each of said cyclones 26 has a dipleg 28 and a flapper valve 30. The dipleg 28 serves to seal the gas from going up the cyclone or gas solid separator. Upon making modifications, as is known to those skilled in the art, an apparatus can be utilized as is shown in U.S. Pat. No. 4,502,947 which issued to Haddad et al. This patent is hereby incorporated by reference. Pressure surges are minimized via the flapper valve 30. Subsequently, these fines are returned to the reactor 10 for further treating and coating. Effluent gases resultant from the process are removed from reactor 10 via line 16. Any coal fines remaining in the effluent gas can be used as a combustion gas in the heater to generate hot gas for the dryer. Alternatively, fines can be removed from the effluent gas via a bag filter before discharging to the atmosphere.

In a preferred embodiment, the coal is simultaneously cooled and treated with said pyrophoric protection fluid to obtain the finished product. In this embodiment, the unsegregated hot dried coal is charged to the reactor 10 for treating. However, as is preferred, the coarse fraction is separated from the fine coal fraction before entering the reactor 10 via 18 as is shown in FIG. 2. Thus, only the fine coal fraction will enter the reactor 10 in this embodiment and receive said protection fluid for stabilization of the fine coal fraction.

Agents proposed for use as a pyrophoric particle protection fluid or treating agent include heavy oils, petroleum resids, mixtures of tall oil and rosin, and gelatinized starch. Heavy hydrocarbonaceous materials utilized as pyrophoric protection fluids or treating agents are discussed in U.S. Pat. No. 3,985,517 which issued to Johnson on Oct. 12, 1976. This patent is hereby incorporated by reference.

Hot dried coal, of about 150° to about 250° F., which can receive the treating agent, may be introduced into reactor 10 either at the reactor top 18 or alternatively into the side of the reactor via conduit 20 as is shown in FIG. 2. In order to effectively contact the hot dried coal with the treating agent, the coal when entering either the top or side of reactor 10 into the coating-/cooling zone may be sprayed by a vaned rotating disk 32 as is shown in FIG. 2 to obtain the desired distribution and mixing of coal and treating agent. When introduced as a spray, the falling coal captures the mist of the treating agent which is carried up by the cooling and fluidization gas entering the reactor via line 12. This cooling and fluidization gas is of a temperature of about 32° to about 80° F. Gases which can be utilized for cooling and fluidization in the smaller fluidization zone include heat exchanged effluent gas from line 16, combustion gases from the dryer, air, inert gases, e.g. nitrogen, carbon dioxide, and mixtures thereof.

Although the vaned rotating disk sprayer may be used for distribution of the hot dried coal entering the top of reactor 10 via line 18, it is particularly preferred to use the rotating disk when the treating agent is introduced at the middle of the reactor which causes a spray to form.

As previously mentioned, while both the combined coarse and fine coal fractions can be treated as above discussed, it is preferred to separate the coarse coal fraction from the fine fraction prior to introducing the coal into the reactor 10 via line 20. Feeding of the fine fraction can be made more efficient by placing a multiplicity of inlets similar to line 20 around the circumference of the top of reactor 10. It is preferred to have the fine fraction less than about 80 mesh (Tyler). The fine fraction alone is then introduced into the coating/cooling zone of reactor 10. Utilization of this embodiment increases the efficiency of contacting the coal fines simultaneously with the treating agent or pyrophoric protection fluid. This increased contacting efficiency results in greater stabilization of the coal and minimization of the amount of treating agent required.

While the embodiments are directed to low rank coal particles, these embodiments can be used in other applications where product dusts present fire and explosion hazards. Product dusts which can be treated include grain dust and wood dust. Other utilizations can be employed in grain elevator operations, saw mill operations, fertilizer granulization operations, and grain treatment operations.

The amount of pyrophoric protection fluid or treating agent which can be used depends of course on the nature of the material used and the material to be treated, as is known to those skilled in the art. In one embodiment, it is preferred to use gelatinized starch. Depending upon operating conditions, gelatinized starch will be employed in about 0.01 to about 5 weight percent of the dried coal entering the reactor 10 when the fluidizing and cooling fluid is injected at from about 5–20 feet per second at the lower or fluidization section. For the spouting bed to become operational, the cooling fluid is injected at a rate of about 1 to about 5 feet per second into the lower section, gelatinized starch can be employed in about 0.01 to about 5 weight percent of the dried coal entering reactor 10.

While preferred forms of one embodiment of the invention have been shown, modifications may be made thereto within the spirit and scope of this disclosure as defined by the appended claims as is known to those skilled in the art.

What is claimed:

1. A method for protection of heated and dried pyrophoric particles, such as low rank coals, containing a reduced moisture content by treating said particles with a pyrophoric protection fluid within a vessel having a gas-solid separator in combination with a cooling fluid comprising:

(a) introducing said heated and dried pyrophoric particles into a vessel which vessel lacks a means for supporting said particles during cooling thereof;

(b) fludizing said particles with said cooling fluid at ambient temperature;

(c) applying a pyrophoric protection fluid to said fluidized particles thereby coating said particles sufficiently to cause at least a substantial portion of said particles to agglomerate and fall while simultaneously cooling said agglomerated particles; and (d) removing continuously said agglomerated cooled particles and said cooling fluid from said vessel.

2. The method as recited in claim 1 where in step (b) said pyrophoric protection fluid is at least one member selected from the group consisting of petroleum residual oil, heavy oil, a mixture of tall oil and rosin, and gelatinized starch, in an amount of from about 0.01 weight percent to about 5 weight percent of said particles.

3. The method as recited in claim 1 where said heated and dried particles are members selected from the group consisting of grain dust, wood dust, and low rank coal.

4. The method as recited in claim 1 where in step (a) said heated and dried particles comprise a low rank coal which is heated to a temperature of from about 150° to about 250° F.

5. The method as recited in claim 1 where in step (d) said agglomerated cooled particles comprise a low rank coal which is cooled to a temperature from about 80° to about 120° F.

6. The method as recited in claim 1 where in step (b) said cooling fluid is a member selected from the group comprising inert gases and air.

7. The method as recited in claim 1 where in step (a) said heated particles are introduced into said vessel as a spray by a vaned rotating disk type sprayer.

8. The method as recited in claim 1 where in step (b) said cooling fluid is injected into the bottom of said vessel which bottom is of a smaller diameter than the top of said vessel and the velocity of said cooling fluid injected into the bottom of said vessel is from about 5 to about 20 feet per second, which is sufficient to carry over untreated particles into the top of said vessel.

9. The method as recited in claim 1 where in step (c) said pyrophoric protection fluid forms a mist which mist and unagglomerated lighter particles rise into the top of said vessel and recycle back into said pyrophoric protection fluid by at least one gas-solid separator.

10. The method as recited in claim 1 where in step (c) said pyrophoric protection fluid forms a mist which mist and unagglomerated lighter particles rise into the top of said vessel and recycle back into said phyrophoric protection fluid by at least one gas-solid separator which comprises an external cyclone separator.

11. The method as recited in claim 1 where in step (c) said pyrophoric protection fluid forms a mist which mist and unagglomerated lighter particles rise into the top of said vessel and recycle back into said pyrophoric protection fluid by at least one gas-solid separator which comprises an internal separator.

12. A method for protection of heated and dried pyrophoric particles, such as low rank coals, containing a reduced moisture content by treating said particles with a pyrophoric protection fluid within a vessel having a fluidizing zone and a coating/cooling zone within which is contained a gas-solid separator in combination with a cooling fluid comprising:

(a) separating said heated and dried pyrophoric particles which are heated to a temperature of about 150° to about 250° F. into a coarse fraction and a fine fraction;

(b) introducing said fine fraction into the coating-/cooling zone of said vessel which vessel lacks a means for supporting said particles during cooling thereof;

(c) fluidizing said particles with said cooling fluid at a temperature of from about 32° F. to about 80° F. where said fluid is injected into said fluidizing zone which zone is of a diameter ratio to said coating-/cooling zone so that the velocity of said cooling fluid obtains a substantial level of fluidization for effective mixing of said particles in said fluidizing zone;

(d) applying a pyrophoric protection fluid to said fluidized particles thereby coating said particles sufficiently to cause at least a substantial portion of said particles to agglomerate and fall, unagglomerated particles to rise along with unutilized mist from said protection fluid, while simultaneously cooling said agglomerated particles;

(e) removing continuously said agglomerated cooled particles, said mist and cooling fluid from said vessel;

(f) causing said unagglomerated particles to enter a gas-solid separator where said particles reenter said coating/cooling zone after being separated from said mist, cooling fluids, and any resultant gases via said separator; and (g) removing continuously said agglomerated cooled particles, mist, cooling fluids and any resultant gases from said vessel.

13. The method as recited in claim 12 where in step (d) said pyrophoric protection fluid is at least one member selected from the group consisting of petroleum residual oil, heavy oil, a mixture of tall oil and rosin, and gelatinized starch, in an amount of from about 0.01 weight percent to about 5 weight percent of said particles.

14. The method as recited in claim 12 where said heated and dried particles are members selected from the group consisting of grain dust and wood dust.

15. The method as recited in claim 12 where in step (d) said agglomerated cooled particles comprise a low rank coal which is cooled to a temperature from about 80° to about 120° F.

16. The method as recited in claim 12 where in step (c) said cooling fluid is a member selected from the group comprising inert gases and air.

17. The method as recited in claim 12 where in step (d) said pyrophoric protection fluid forms a mist which mist and unagglomerated light particles rise into the top of said vessel and recycle back into said pyrophoric protection fluid by at least one gas-solid separator.

18. The method as recited in claim 12 above where in step (d) said pyrophoric protection fluid forms a mist which mist and unagglomerated lighter particles rise into the top of said vessel and recycle back into said pyrophoric protection fluid by at least one gas-solid separator which comprises an external cyclone separator.

19. The method as recited in claim 12 above where in step (d) said pyrophoric protection fluid forms a mist which mist and unagglomerated lighter particles rise into the top of said vessel and recycle back into said pyrophoric protection fluid by at least one gas-solid separator which comprises an internal cyclone separator.

20. A method for protection of heated and dried pyrophoric particles, such as low rank coals, containing a reduced moisture content by treating said particles with a pyrophoric protection fluid within a vessel having a gas-solid separator in combination with a cooling fluid comprising:

(a) introducing said heated and dried pyrophoric particles into a vessel which vessel lacks a means for supporting said particles during cooling thereof;

(b) spouting said particles with said cooling fluid at ambient temperature;

(c) applying a pyrophoric protection fluid to said spouted particles thereby coating said particles sufficiently to cause at least a substantial portion of said particles to agglomerate and fall while simultaneously cooling said agglomerated particles; and (d) removing continuously said agglomerated cooled particles and said cooling fluid from said vessel.

21. The method as recited in claim 20 where in step (c) said pyrophoric protection fluid is at least one member selected from the group consisting of petroleum residual oil, heavy oil, a mixture of tall oil and rosin, and gelatinized starch, in an amount of from about 0.01 weight percent to about 5 weight percent of said particles.

22. The method as recited in claim 20 where said heated and dried particles are members selected from the group consisting of grain dust, wood dust, and low rank coal.

23. The method as recited in claim 20 where in step (a) said heated and dried particles comprise a low rank coal which is heated to a temperature of from about 150° to about 250° F.

24. The method as recited in claim 20 where in step (d) said agglomerated cooled particles comprise a low rank coal which is cooled to a temperature from about 80° to about 120° F.

25. The method as recited in claim 20 where in step (b) said cooling fluid is a member selected from the group comprising inert gases and air.

26. The method as recited in claim 20 where in step (a) said heated particles are introduced into said vessel as a spray by a vaned rotating disk type sprayer.

27. The method as recited in claim 20 where in step (b) said cooling fluid is injected into the bottom of said vessel which bottom is of a smaller diameter than the top of said vessel and the velocity of said cooling fluid injected into the bottom of said vessel is from about 1 to about 5 feet per second, which is sufficient to carry over untreated particles into the top of said vessel.

28. The method as recited in claim 20 where in step (c) said pyrophoric protection fluid forms a mist which mist and unagglomerated lighter particles rise into the top of said vessel and recycle back into said phyrophoric protection fluid by at least one gas-solid separator.

29. The method as recited in claim 20 where in step (c) said pyrophoric protection fluid forms a mist which mist and unagglomerated lighter particles rise into the top of said vessel and recycle back into said pyrophoric protection fluid by at least one gas-solid separator which comprises an external cyclone separator.

30. The method as recited in claim 20 where in step (c) said pyrophoric protection fluid forms a mist which mist and unagglomerated lighter particles rise into the top of said vessel and recycle back into said pyrophoric protection fluid by at least one gas-solid separator which comprises an internal cyclone separator.

* * * * *